United States Patent [19]

Bruchmiller

[11] Patent Number: 5,012,876

[45] Date of Patent: May 7, 1991

[54] ROTARY DRILL BIT PROVIDING SEPARATION OF LIQUID FROM GAS

[75] Inventor: Tod T. Bruchmiller, Houston, Tex.

[73] Assignee: Dresser Industries, Inc., Dallas, Tex.

[21] Appl. No.: 473,417

[22] Filed: Feb. 1, 1990

[51] Int. Cl.[5] ..... E21B 10/24; E21B 10/18

[52] U.S. Cl. ..... 175/69; 175/318; 175/337; 175/339

[58] Field of Search ..... 175/337, 69, 339, 318, 175/324; 55/442, 443, 159

[56] References Cited

U.S. PATENT DOCUMENTS

| | | | |
|---|---|---|---|
| 147,565 | 2/1874 | Mackey | 55/442 |
| 2,329,745 | 9/1943 | Crook | 255/71 |
| 3,125,175 | 3/1964 | Medlock et al. | 175/337 |
| 3,177,634 | 4/1965 | Latham, Jr. et al. | 55/443 X |
| 3,788,408 | 1/1974 | Dysart | 175/337 |
| 3,964,554 | 6/1976 | Ricks et al. | 175/17 |
| 4,154,313 | 5/1979 | Dysart et al. | 175/318 |
| 4,184,554 | 1/1980 | Levefelt | 175/318 X |
| 4,245,710 | 1/1981 | Dolezal et al. | 175/337 |
| 4,359,113 | 11/1982 | Morris | 175/337 |
| 4,428,442 | 1/1984 | Steinke | 175/337 |
| 4,515,229 | 5/1985 | Drummond et al. | 175/337 |
| 4,541,494 | 9/1985 | Drummond et al. | 175/324 X |
| 4,610,318 | 9/1986 | Goodfellow | 175/339 |
| 4,805,709 | 2/1989 | Johnsey et al. | 175/337 X |

FOREIGN PATENT DOCUMENTS

| | | | |
|---|---|---|---|
| 220903 | 7/1968 | U.S.S.R. | 175/337 |
| 1177439 | 9/1985 | U.S.S.R. | 175/337 |

*Primary Examiner*—Hoang C. Dang

*Attorney, Agent, or Firm*—Richards, Medlock & Andrews

[57] ABSTRACT

This invention relates to a rotary drill bit having a body with leg members, where each of the leg members has a projecting conical cutter receiving journal. Each conical cutter has an axially extending recess open at one end and is rotatably mounted on the journal by friction reducing bearings interior to the conical cutters. The drill bit has a main cavity which extends down the center of the drill bit body. A jet nozzle provides an exit opening at the bottom of the main cavity. At least one passageway extends to and opens into the main cavity at one end and extends to and opens into the bearings at the other end. The end of the at least one passageway which extends to the main cavity is provided with a plurality of openings and a plurality of deflectors associated with the openings. When a gas-liquid mixture is passed through the main cavity, the deflectors will cause an abrupt change in the gas flow direction. The gas travels around the deflectors, through the openings and is directed to the bearings so as to cool and clean the bearings. The liquid particles continue on and mix with the remaining gas-liquid mixture. This gas-liquid mixture having a higher concentration of liquid exits the jet nozzle and suppresses dust in the drilling environment.

20 Claims, 4 Drawing Sheets

ROTARY DRILL BIT PROVIDING SEPARATION OF LIQUID FROM GAS

TECHNICAL FIELD OF THE INVENTION

This invention relates to rotary drill bits. In a specific aspect, the invention relates to rotary drill bits having at least one stand pipe which separates part of the gas in a gas-liquid mixture so that the separated gas can be utilized to cool and clean the bearings. The liquid in the gas-liquid mixture is prevented from contacting and damaging the bearings and this liquid mixes with the remaining gas-liquid mixture and this gas-liquid mixture more concentrated with the liquid exits the rotary drill bit and suppresses dust in the drilling environment.

BACKGROUND OF THE INVENTION

Rotary drill bits can be used in blast hole drilling. In general, blast holes have a depth in the range of about 50 to about 150 feet and are filled with a blasting material for breaking up the earth during mining operations. The body of the drill bit typically used for drilling blast holes is attached to a drill pipe by a threaded member on the body of the bit. The drill pipe is supported and rotated by a drilling rig. The body of the drill bit typically has three legs, each of the legs having a projecting, conical cutter-receiving journal. Three conical cutters, each having an axially extending recess open at one end, are rotatably mounted on respective journals with the use of friction reducing bearings interior to the conical cutters. Each conical cutter has rock cutting teeth or inserts on the outer surface of the conical cutter. The weight of the drill pipe above the drill bit and the rotation of the drill bit cause the conical cutters to independently rotate about their individual journals and cut through the earth.

Many drill bits have a central passageway which extends from the top to the bottom of the bit. A plurality of branch passageways extend from the central passageway and terminate at the bearings. These various branch passageways conduct air or other gas to the bearings to cool the bearings and to wash away drilling debris. Jet nozzle exits are generally located at the bottom of the drill bit adjacent to the conical cutters. Air or other gas discharged from the nozzles washes drilling debris away from the conical cutters and out of the drill hole.

During drilling operations, the resulting drilling debris creates a lot of dust. Such dust pollutes the air and can be a health hazard to workers in the area. Drilling equipment or other equipment may also be damaged by the dust. In order to reduce this dust, water or some other liquid can be mixed in with the air or other gas traveling through the central passageway in the drill bit, so that the liquid in this gas-liquid mixture exits the jet nozzles and suppresses the dust. However, the gas-liquid mixture also travels to the bearings and the liquid in the mixture can be harmful to the bearings. Water can corrode the bearings creating corrosion pits which can lead to cracking of the bearings.

In order to reduce the problem of water corrosion in the bearings, many drill bits which provide for the gas-liquid mixture traveling down the central passageway have a gas-liquid separator which separates the liquid from the gas so that only gas travels through the bearings. The separated liquid, on the other hand, exits through the jet nozzles and suppresses the dust. U.S. Pat. No. 3,788,408 by Dysart provides an example. The patent discloses different embodiments where a baffle element deflects a gas-liquid mixture. Due to the velocity of the gas-liquid mixture, the deflection of the gas-liquid mixture around the baffle separates out an at least substantially liquid free gas stream. Part of the gas undergoes a change in direction toward the bearings while the inertia of the heavier liquid causes it to continue on with the remaining gas-liquid mixture and exit through the jet nozzle. The at least substantially liquid free gas stream travels into the passageways leading to the bearings. However, a problem is that not all of the liquid is prevented from traveling to the bearings. Liquid can splash, for example because of turbulence in the gas-liquid mixture, into the passageway leading to the bearings.

It is an object of this invention to provide an improved apparatus for separating liquid from gas in a drill bit where the separated gas cools and cleans the bearings and the separated liquid suppresses dust in the drilling environment. It is a further object to minimize the amount of liquid which travels to the bearing of the drill bit.

SUMMARY OF THE INVENTION

This invention provides an improved arrangement for separating liquid from gas in a gas-liquid mixture, with the liquid exiting a jet nozzle at the bottom of the main cavity into the drilling environment to suppress dust, and with the air traveling down passageways leading to the bearings to cool and clean the bearings. The rotary drill bit has a body with leg members where each leg member has a projecting, conical cutter receiving journal. A conical cutter having an axially extending recess open at one end, is rotatably mounted to the journal by the use of friction reducing bearings interior to the conical cutter. A main cavity in the center of the drill bit body carries a gas-liquid mixture.

In one embodiment, each leg of the drill bit is provided with a passageway or a pipe which extends to and opens into the main cavity at one end and extends to and opens into the bearings at the other end. The end of the pipe which extends to the main cavity is provided with a plurality of openings and with a plurality of deflectors associated with the openings. In this embodiment, when a gas-liquid mixture is passed down the main cavity, the deflectors will cause an abrupt change in the gas flow direction. The lighter gas particles, typically air particles, will travel around the deflectors and pass through the openings and travel to the bearings. The liquid particles, typically water, continue on by their inertia and mix with the remaining gas-liquid mixture. This gas-liquid mixture having a higher concentration of liquid travels to the bottom of the main cavity and exits through a jet nozzle into the drilling environment to suppress dust.

In another embodiment, a central passageway or pipe is provided which extends through the center of the main cavity and has an end in the main cavity which has a plurality of openings and deflectors associated with the openings. Each leg member has a passageway which extends to and opens into the central passageway at one end and extends to and opens into the bearings at the other end. The central passageway with deflectors separates the gas from the liquid and directs the gas to the individual passageways for each leg.

The deflectors and openings which are provided at the end of a passageway can be arranged in several different configurations. For example, each deflector can be rectangular shaped and be associated with a slot opening. A circular deflector can be associated with a circular opening. As another example, a rectangular deflector may be associated with a plurality of circular openings. There are numerous possibilities.

In another embodiment, a resilient member may be attached in juxtaposition to the interior surface of the passageways having openings and deflectors. During normal operation of the drill bit, when the gas-liquid mixture is being circulated, the gas that is separated from the water by the deflectors enters through the openings, deforming the resilient member away from the openings, and continues into the passageways leading to the bearings. When the circulating gas-water mixture is turned off, the resilient member seals against the openings and creates air pockets in the region around the bearings. These air pockets will contain and prevent ground water and drilling debris from entering the bearing cavities.

In another embodiment, the central passageway having the openings and deflectors not only has a resilient member on its interior surface but also has a frusto-conical member which has its inner periphery attached to the central passageway and its outer periphery attached to the walls of the main cavity. The frusto-conical member is provided with perforations. A resilient member which has a frusto-conical configuration is disposed in juxtaposition with the lower surface of the frusto-conical member. During normal operation, water that is deflected off of the deflectors passes downwardly towards the frusto-conical member and deforms the resilient member away from the perforations in the frusto-conical member allowing the water to continue downwardly through the main cavity where it will eventually exit through the jet nozzle. If the supply of the gas-liquid mixture is turned off, the resilient member seals against the perforations. This creates air pockets in the interior of the drill bit preventing water or drilling debris from entering through the jet nozzles into the main cavity. Any water that enters the main cavity is blocked by the resilient member sealed against the perforations and cannot get past. The resilient member on the frusto-conical member and the resilient member on the interior surface of the central passageway work in conjunction to prevent water or drilling debris from entering the region around the bearings.

BRIEF DESCRIPTION OF THE DRAWINGS

Further features and advantages will become apparent from the following detailed description of the preferred embodiment of the invention, as illustrated in the accompanying drawings in which like reference characters refer to the same elements or functions throughout the views, and in which.

DETAILED DESCRIPTION

Figure 1:
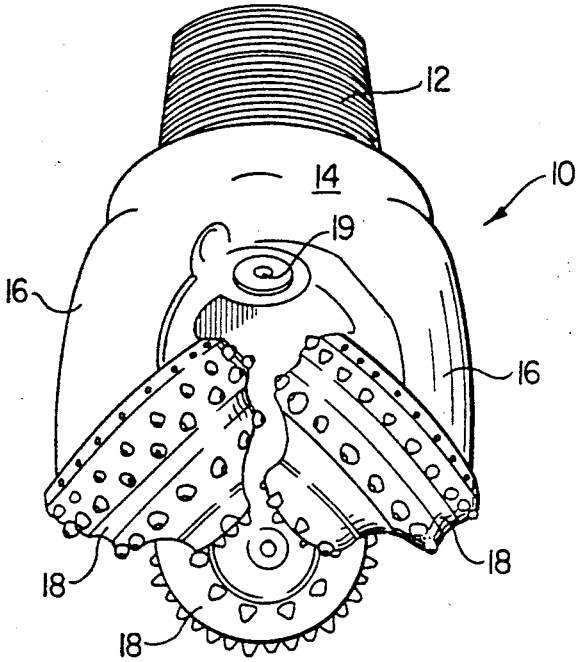
FIG. 1 is a perspective view of a rotary blast hole drill bit of the invention.
Figure 2:
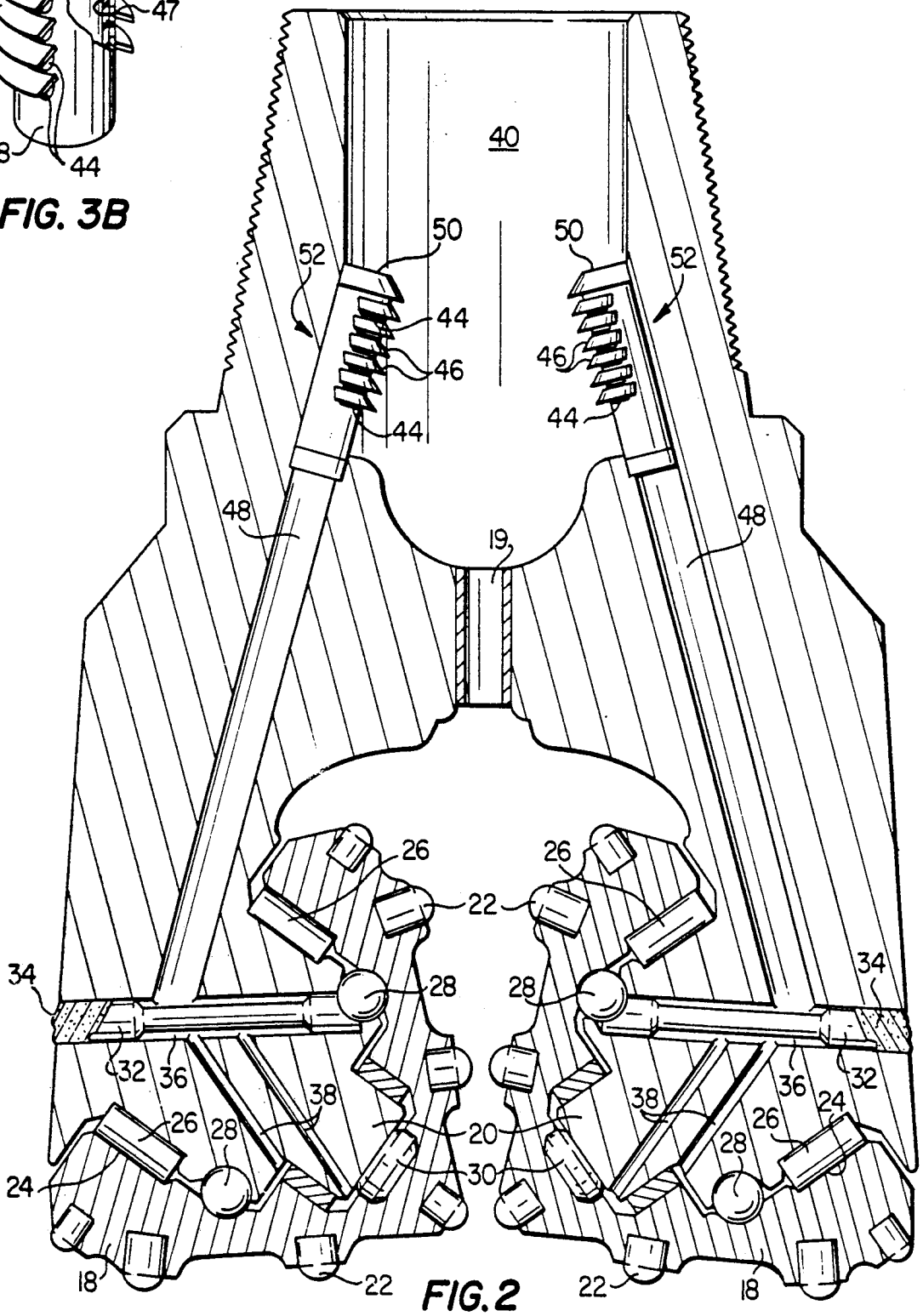
FIG. 2 is a cross-sectional view of two legs of the drill bit in FIG. 1, illustrating one embodiment of the invention.

FIG. 1 illustrates a drill bit of the type to which the invention pertains. Drill bit 10 includes a top threaded portion 12 for threaded connection to a drill pipe (not shown). The body 14 of the drill bit has three legs 16 with conical cutters 18 attached. A jet nozzle 19 is also shown. FIG. 2 illustrates a cross-sectional view of drill bit 10 particularly showing the interior of the body 14 and two of the legs 16 each having a conical cutter 18 attached.

From FIG. 2, it can be seen that a portion of each leg 16, hereinafter referred to as the journal 20, is angled with reference to the vertical axis, which includes the threaded portion 12. Each journal 20 receives a conical cutter 18. Each conical cutter 18 includes several cutting teeth 22 which are the elements which cut through the earth during drilling operations. Races 24 which are annular grooves, are formed on the interior of each conical cutter 18 and/or the exterior of each journal 20 so that when the conical cutter is placed on the journal, these races will accommodate roller bearings 26 and ball bearings 28. A thrust button 30 is placed between journal 20 and conical cutter 18 to reduce stress between the journal and the conical cutter. Roller bearings 26 and ball bearings 28 provide for rotatable engagement between conical cutter 18 and journal 20, and also serve to retain the conical cutter in assembly with the journal. During assembly of drill bit 10, ball bearings 28 are fed through a ball plug hole (not shown), and when the ball bearings are in place, ball plug 32 is inserted and secured by a weld 34. Ball plug 32 is formed with a conduit 36. Two passageways 38 extend and open into conduit 36 at one end and extend and open into the bearings 26 and 28 at the other end.

A main cavity 40 extends down the center of the drill bit body 14. Jet nozzle 19 provides an exit opening at the bottom of main cavity 40. Passageways 48 extend to and open into main cavity 40 at one end and extend to and open into conduit 36 of ball plug 32 at the other end. The end of passageway 48 which extends into main cavity 40 is provided with a conical cap 50, a plurality of openings 44 and a plurality of deflectors 46 associated with the openings. This end of the passageway 48 fits against an interior wall 52 of leg 16.

Figure 3A:
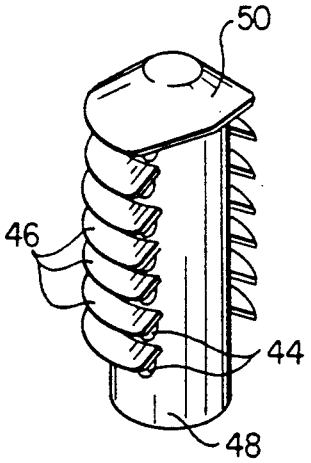
FIG. 3A is an enlarged perspective view of the portion of a stand pipe containing deflectors.

FIG. 3A illustrates a closeup of the end of passageway 48 which has the plurality of openings 44 and deflectors 46. Passageway 48 is actually a cylindrical pipe (hereinafter referred to as pipe 48) which is commonly referred to as a stand pipe. In this embodiment, a conical cap 50 covers the end of the pipe 48 which extends into main cavity 40. Conical cap 50 also acts as a deflector and works in conjunction with the other deflectors 46 as will be explained in more detail below. As illustrated in FIG. 3A, the deflectors 46 extend approximately 180° around pipe 48. The remaining approximate 180° of the pipe 48 fits against an interior wall 52 of leg 16 and is free of openings 44 and deflectors 46.

During operation of drill bit 10, a gas-liquid mixture is passed downwardly through main cavity 40. Typically, the gas-liquid mixture is an air-water mixture. The air-water mixture passing through main cavity 40 eventually travels towards the upper end of each pipe 48 having openings 44, deflectors 46 and conical cap 50. The inertia of the heavier water particles causes the water to continue in its original direction. The deflectors 46 might also act to direct some water particles away from openings 44. The lighter air molecules are freer to move and travel around deflectors 46 and conical cap 50 through openings 44. The deflectors 46 cause an abrupt change in the air gas flow direction and divert the free moving air through openings 44. The water particles, due to their inertia, continue in the same direction and mix with the air-water mixture that has not made contact with the deflectors 46 and conical cap 50 and this air-water mixture having a higher concentration of water travels to the bottom of main cavity 40 and exits through jet nozzle 19 into the drilling environment and suppresses dust. The air which travels through openings 44 is essentially free of water and is carried by pipe 48 to conduit 36. The air in conduit 36 travels to passageways 38. Passageways 38 carry the air to roller bearings 26 and ball bearings 28. The air cools and cleans these bearings.

Deflectors 46 and conical cap 50 are more efficient at separating water from air than deflectors disclosed in prior art patents. Typically, in the prior art patents, a single deflector is provided. If water gets past this deflector, for example which might occur if the circulation of the air-water mixture is turbulent or if the water splashes, then the water typically passes into an opening and is carried to the bearings. However, in this invention, there are a plurality of deflectors associated with a plurality of openings. Each deflector 46 causes an abrupt change in air flow in a section of the total air-water stream to direct this air into the opening or openings associated with the deflector. The water particles in this section continue on because of inertia. The totality of deflectors act as a system to separate water from air. If water gets around one deflector, another deflector might prevent it from entering an opening. Also, if the air flow is not diverted towards an opening by one of the deflectors, another deflector may divert it towards an opening. If water somehow enters one of the openings, it will only be a minute amount of water from a section of the air-water stream.

Figure 3B:
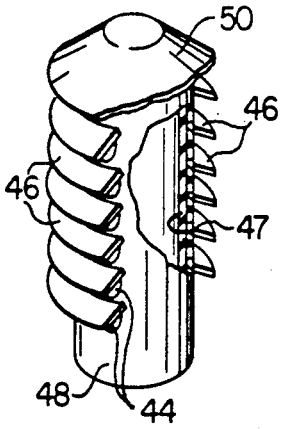
FIG. 3B is partial cross-sectional view of the stand pipe illustrated in FIG. 3A having a resilient member in its interior.

FIG. 3B illustrates a partial cross-sectional view of the stand pipe 48 illustrated in FIG. 3A except that the stand pipe in this embodiment has a resilient member 47 attached to and in juxtaposition with its interior surface. U.S. Pat. No. 4,154,313, which is incorporated herein by reference, also discloses the use of a resilient member in the interior of a stand pipe. As also discussed in U.S. Pat. No. 4,154,313, if a water bearing formation has been encountered during the drilling of the borehole, the water migrates into the wellbore when the circulation of air through jet nozzle 19 ceases. When this occurs, water rises in the wellbore and completely surrounds the drill bit 10. When the circulating air is turned off, the pressure within the drill bit 10 drops. The borehole pressure being greater than the pressure within the drill bit 10 tends to move water and cuttings into the bearing cavities. Water might then migrate through passageways 38 and pipe 48 into main cavity 40. However, if resilient member 47 is provided, it acts as a flow control valve to prevent the flow of water into the drill bit 10. Since the borehole pressure is greater than the pressure within the drill bit 10 due to the ground water in the borehole, the resilient member 47 will seal tightly against openings 44 and sufficiently seal off passage of air back into the drill bit thus creating air pockets in passageways 38 and pipe 48 and around the bearings 26 and 28. These air pockets will contain and prevent the ground water from entering the bearing cavities. Some small amounts of water and drill cuttings may enter the lower extremities of the bearing cavities, but with the air pockets located in the region around the bearings 26 and 28 and in the passageways 38 and pipe 48 the invasion of the water and cuttings should be minor. Furthermore, any water and cuttings that enter will be easily expelled when the flow of circulating air is restarted. During normal operation of the drill bit 10, when the air-water mixture is being circulated, the air that is separated from the water by deflectors 46 enters through openings 44, deforming resilient member 47 away from openings 44, and continues into passageway 48.

Figure 4B:
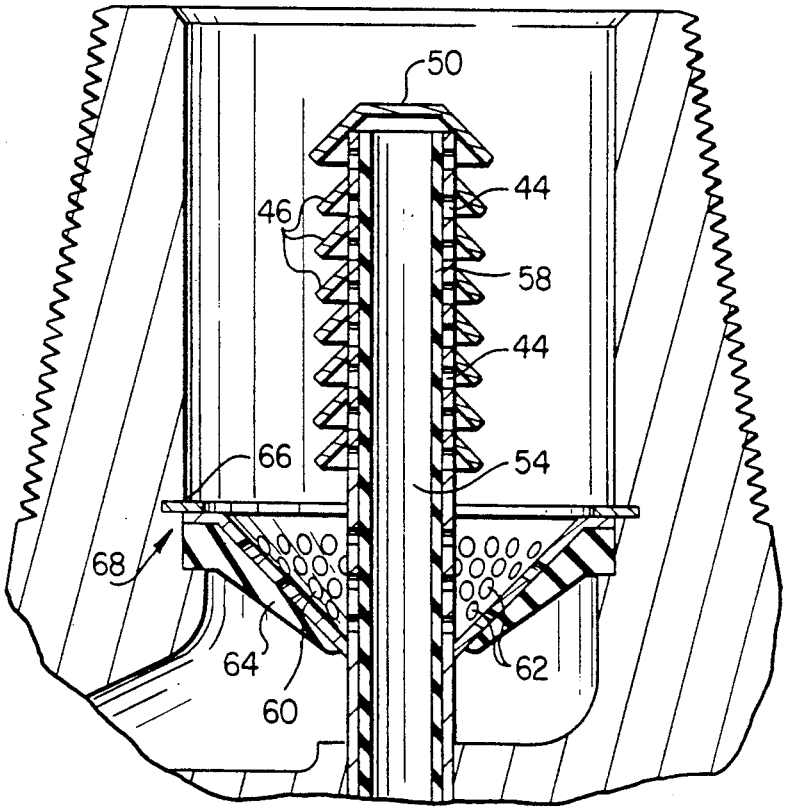
FIG. 4B is a partial cross-sectional view illustrating the embodiment in FIG. 4A having additional structure.
Figure 4A:
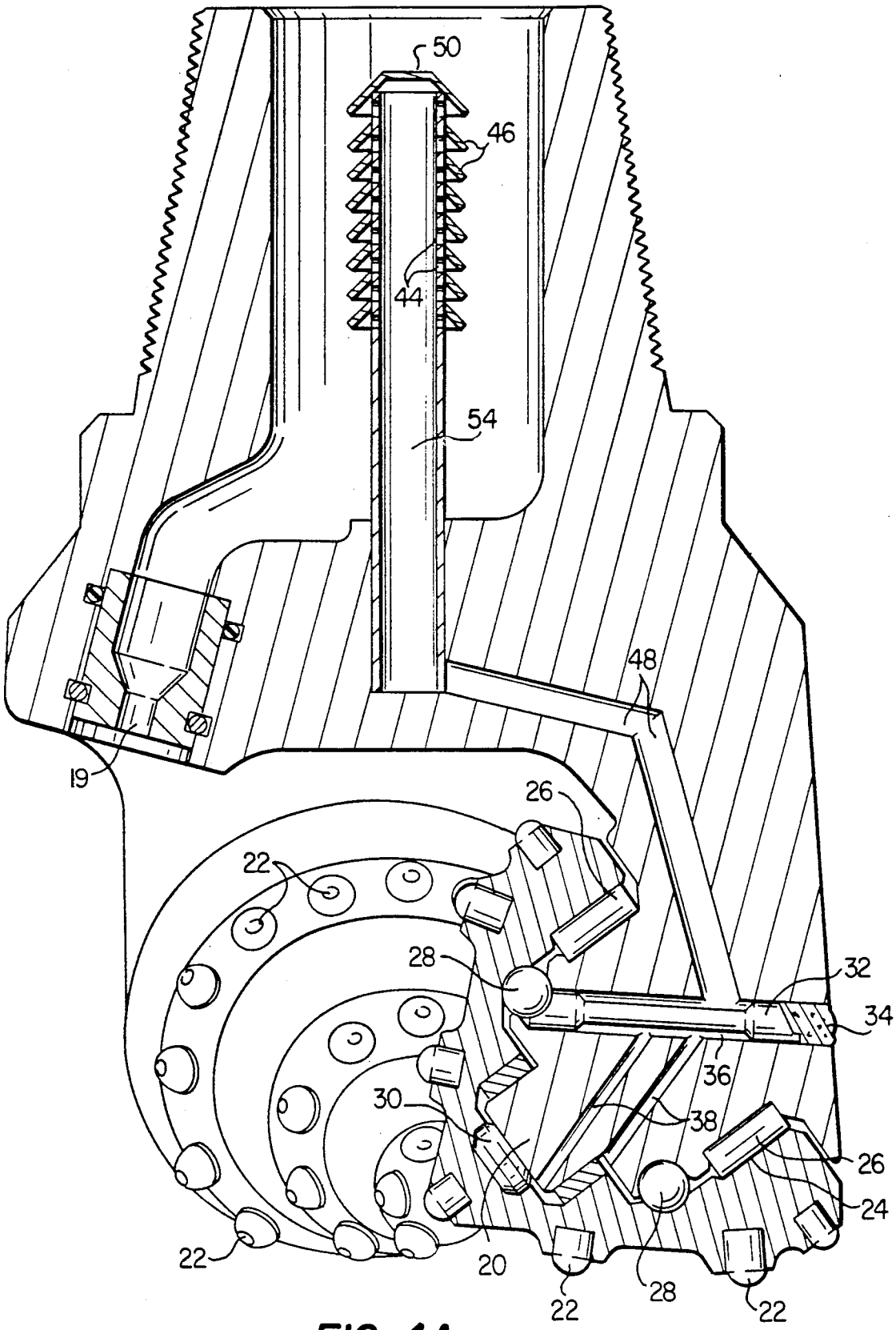
FIG. 4A is a partial cross-sectional view of the drill bit in FIG. 1, illustrating another embodiment of the invention.

FIG. 4A illustrates another embodiment of this invention. In this embodiment, a central cylindrical pipe 54 is provided which extends downwardly through main cavity 40. Pipes 48 extend to and open into central cylindrical pipe 54. None of the pipes 48 has openings 44 or deflectors 46, rather central cylindrical pipe 54 is provided with openings 44 and deflectors 46 at the end opposite to which pipes 48 are connected. The openings 44 and deflectors 46 are positioned around the entire circumference of central cylindrical pipe 54 rather than only 180° as is the case for the pipes 48 in the embodiment in FIG. 2. In this embodiment, water is separated from air by the same technique as the previous embodiment discussed, except that deflectors 46 on single central cylindrical pipe 54 cause the air-water separation rather than the deflectors on each pipe 48.

FIG. 4B illustrates an embodiment which is a variation of the embodiment in FIG. 4A. A resilient member 58 is positioned in juxtaposition with the inner diameter of central cylindrical pipe 54. Resilient member 58 serves the same function as resilient members 47 in the embodiment illustrated in FIG. 3B. Thus, when an air-water mixture is flowing down main cavity 40 the air that passes through openings 44 deforms resilient member 58 away from the openings allowing the air to pass down central cylindrical pipe 54 to pipes 48 and eventually to the bearings 26 and 28. If the air-water mixture is shut off, resilient member 58 closes the openings and creates an air pocket in the region around bearings 26 and 28 to prevent any debris and water in the borehole from entering into this region. As illustrated in FIG. 4B, a frusto-conical member 60 can also be provided which has its inner periphery attached to central cylindrical pipe 54. Frusto-conical member 60 is retained therein by a lock ring 66 that is disposed in an annular groove 68 in the walls of main cavity 40. See U.S. Pat. No. 4,154,313 which is incorporated herein by reference. Frusto-conical member 60 is provided with perforations 62. A resilient member 64 which has a frusto-conical configuration is disposed in juxtaposition with the lower surface of frusto-conical member 60. During normal operation, air is separated from the water by deflectors 46 and conical cap 50 and the water mixes with the remaining air-water mixture. The air-water mixture concentrated with the separated water deforms resilient member 64 away from the perforations 62 in frusto-conical member 60 allowing the mixture to continue downwardly through main cavity 40 where it will eventually exit through jet nozzle 19 (not shown in FIG. 4B). If the supply of the air-water mixture is shut off, then the borehole pressure will force resilient member 64 to seal against the perforations 62. This will create air pockets in the interior of drill bit 10 preventing water or drilling debris from entering through jet nozzles 19 into main cavity 40. Furthermore, even if water or cuttings were to pass into main cavity 40, resilient member 64 is sealed tightly against perforations 62 preventing water or drilling debris from getting past frusto-conical member 60 and thus preventing water or drilling debris from traveling to bearings 26 and 28. Resilient members 58 and 64 can work in conjunction to prevent water or drilling debris from entering the region around bearings 26 and 28.

Figure 5:
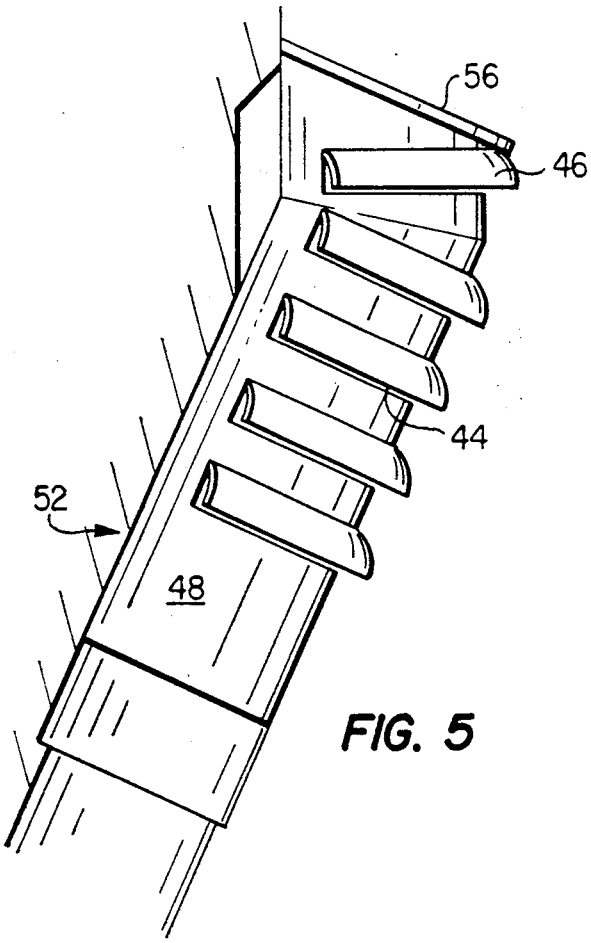
FIGS. 5-7 are enlarged perspective views of the upper portion of the stand pipe with different configurations of deflectors and openings.
Figure 6:
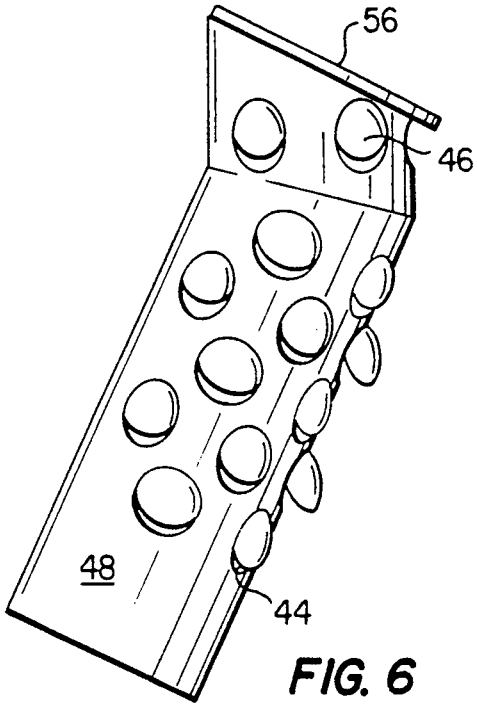
Figure 7:
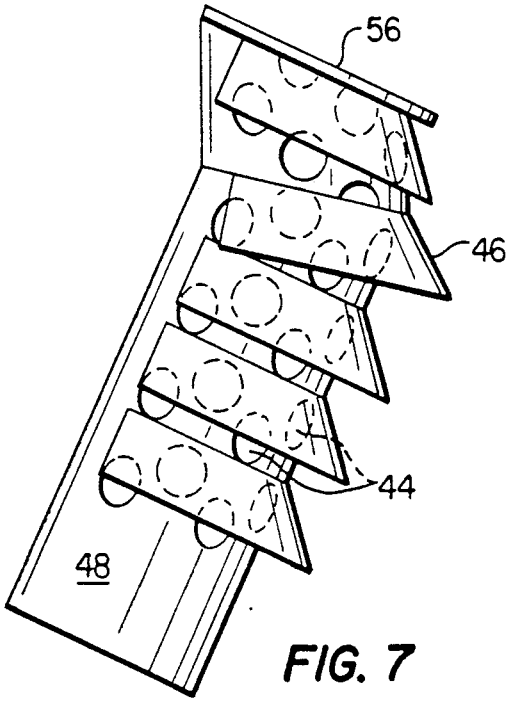

FIGS. 5–7 illustrate the top portion of pipes 48 with different configurations of deflectors 46 and openings 44. In FIG. 5, the openings 44 are slots and a single rectangular-shaped deflector 46 is associated with each slot. In FIG. 6, the openings 44 are circular and each opening has a circular deflector 46 associated with it. In FIG. 7, openings 44 are again a plurality of circular openings. In this embodiment, however, each rectangular deflector 46 is associated with a plurality of the circular openings 44. In the embodiments of FIGS. 5–7, the plurality of openings 44 and deflectors 46 are positioned 180° around the pipe so that the deflectors in the openings are exposed to the gas-liquid mixture in main cavity 40 and the remaining 180° of the pipe fits against wall 52 of each leg passageway. The top of the pipes illustrated in FIGS. 5–7 have flat caps 56 which close the opening on the top of the pipe. Conical caps like conical cap 50 illustrated in FIGS. 2–4B can also be utilized. The flat caps 56 partially extend past the circumference of the pipe 48 so as to partially act as a deflector. If the pipe 48 is a single central cylindrical pipe, such as central cylindrical pipe 54 in FIGS. 4A and 4B, the openings 44 and deflectors 46 are positioned around the entire circumference of pipe 48.

While the following illustrates and discloses the preferred embodiment of the invention with respect to the composition of the drill bit, it is to be understood that many changes can be made in the drill bit design such as the quantity, shape, and positioning of the deflectors and the quantity, shape, and positioning of the openings as a matter of engineering choices without departing from the spirit and scope of the invention, as defined by the appended claims.

I claim:

1. A drill bit having fluid circulation, comprising:

a main body having a cavity adapted to receive a gas-liquid mixture from a fluid source so that the gas-liquid mixture from said fluid source moves in a general direction of flow in said cavity;

at least one cutting member rotatably attached to said main body;

bearings for reducing friction between said main body and each said at least one cutting member;

at least one passageway, each said at least one passageway having one end which extends to and opens into the bearings of a cutting member and the other end which extends into said cavity and which has a plurality of openings to said cavity, said plurality of openings being positioned at a series of locations in said other end of said passageway with each said location containing at least one of said plurality of openings, which locations are spaced apart from each other with respect to the general direction of flow of said gas-liquid mixture in said cavity adjacent to said other end of said passageway; and a plurality of deflectors, each of said deflectors being positioned at a respective one of said locations and associated with at least a respective one of said plurality of openings and each of said plurality of openings being associated with a deflector such that when fluid is supplied from said fluid source, each deflector of said plurality of deflectors at least substantially precludes liquid in said fluid from entering the at least one opening associated with that deflector so that liquid in said fluid continues to travel in the same general direction of flow in said cavity adjacent to said other end of said passageway but each deflector of said plurality of deflectors permits the diversion of a portion of the gas in said fluid so that the thus diverted portion of gas travels into at least one opening associated with that deflector and into said at least one passageway which directs gas substantially free of liquid to the bearings of a cutting member to cool and clean the bearings.

2. A drill bit having fluid circulation, comprising:

a main body;

at least one cutting member rotatably attached to said main body;

bearings for reducing friction between said main body and each said at least one cutting member;

at least one passageway, each said at least one passageway having one end which extends to and opens into the bearings of a cutting member and the other end which extends to a fluid source supplying a gas-liquid mixture and which has a plurality of openings to said fluid source; and a plurality of axially spaced-apart deflectors associated with said openings such that when fluid is supplied from said fluid source, liquid in said fluid continues to travel in the same direction but each deflector of said plurality of deflectors diverts a portion of gas in said fluid so that said gas travels into said openings and into said at least one passageway which directs gas to the bearings of a cutting member to cool and clean the bearings;

wherein each deflector of said plurality of deflectors is associated with a plurality of openings.

3. A drill bit in accordance with claim 1, wherein each deflector of said plurality of deflectors is associated with a single opening.

4. A drill bit having fluid circulation, comprising:

a main body;

at least one cutting member rotatably attached to said main body;

bearings for reducing friction between said main body and each said at least one cutting member;

at least one passageway, each said at least one passageway having one end which extends to and opens into the bearings of a cutting member and the other end which extends to a fluid source supplying a gas-liquid mixture and which has a plurality of openings to said fluid source; and a plurality of axially spaced-apart deflectors associated with said openings such that when fluid is supplied from said fluid source, liquid in said fluid continues to travel in the same direction but each deflector of said plurality of deflectors diverts a portion of gas in said fluid so that said gas travels into said openings and into said at least one passageway which directs gas to the bearings of a cutting member to cool and clean the bearings;

wherein each said at least one passageway has a resilient member on its interior surface to seal said openings when fluid circulation in the drill bit stops.

5. A drill bit having fluid circulation, comprising:

a main body;

at least one cutting member rotatably attached to said main body;

bearings for reducing friction between said main body and each said at least one cutting member;

at least one passageway, each said at least one passageway having one end which extends to and opens into the bearings of a cutting member and the other end which extends to a fluid source supplying a gas-liquid mixture and which has a plurality of openings to said fluid source; and a plurality of axially spaced-apart deflectors associated with said openings such that when fluid is supplied from said fluid source, liquid in said fluid continues to travel in the same direction, said liquid eventually exiting through an exit opening into the environment, but each deflector of said plurality of deflectors diverts a portion of gas in said fluid so that said gas travels into said openings and into said at least one passageway which directs gas to the bearings of a cutting member to cool and clean the bearings;

wherein each deflector of said plurality of deflectors is associated with a plurality of openings.

6. A drill bit having fluid circulation, comprising:

a main body;

at least one cutting member rotatably attached to said main body;

bearings for reducing friction between said main body and each said at least one cutting member;

at least one passageway, each said at least one passageway having one end which extends to and opens into the bearings of a cutting member and the other end which extends to a fluid source supplying a gas-liquid mixture and which has a plurality of openings to said fluid source; and a plurality of axially spaced-apart deflectors associated with said openings such that when fluid is supplied from said fluid source, liquid in said fluid continues to travel in the same direction, said liquid eventually exiting through an exit opening into the environment, but each deflector of said plurality of deflectors diverts a portion of gas in said fluid so that said gas travels into said openings and into said at least one passageway which directs gas to the bearings of a cutting member to cool and clean the bearings;

wherein each said at least one passageway has a resilient member on its interior surface to seal said openings when fluid circulation in the drill bit stops.

7. A drill bit having fluid circulation, comprising:

a main body;

at least one cutting member rotatably attached to said main body;

bearings for reducing friction between said main body and each cutting member;

a first passageway interior to said main body having one end which extends to a fluid source supplying a gas-liquid mixture and which has a plurality of openings, and having another end which extends to and opens into at least one second passageway interior to said main body, each said at least one second passageway extending to and opening into said bearings of a cutting member; and a plurality of axially spaced-apart deflectors associated with said openings such that when fluid is supplied from said fluid source, liquid in said fluid continues to travel in the same direction but each deflector of said plurality of deflectors diverts a portion of gas in said fluid so that said gas travels into said openings and into said first passageway which directs the gas to said at least one second passageway which directs gas to the bearings of each cutting member to cool and to clean the bearings;

wherein each deflector of said plurality of deflectors is associated with a plurality of openings.

8. A drill bit having fluid circulation, comprising:

a main body;

at least one cutting member rotatably attached to said main body;

bearings for reducing friction between said main body and each cutting member;

a first passageway interior to said main body having one end which extends to a fluid source supplying a gas-liquid mixture and which has a plurality of openings, and having another end which extends to and opens into at least one second passageway interior to said main body, each said at least one second passageway extending to and opening into said bearings of a cutting member; and a plurality of axially spaced-apart deflectors associated with said openings such that when fluid is supplied from said fluid source, liquid in said fluid continues to travel in the same direction but each deflector of said plurality of deflectors diverts a portion of gas in said fluid so that said gas travels into said openings and into said first passageway which directs the gas to said at least one second passageway which directs gas to the bearings of each cutting member to cool and to clean the bearings;

wherein said first passageway has a resilient member which is placed on its interior surface to seal said openings when fluid circulation in the drill bit stops.

9. A drill bit having fluid circulation, comprising:

a main body;

at least one cutting member rotatably attached to said main body;

bearings for reducing friction between said main body and each cutting member;

a first passageway interior to said main body having one end which extends to a fluid source supplying a gas-liquid mixture and which has a plurality of openings, and having another end which extends to and opens into at least one second passageway interior to said main body, each said at least one second passageway extending to and opening into said bearings of a cutting member; and a plurality of axially spaced-apart deflectors associated with said openings such that when fluid is carried in the main cavity and is directed toward said openings, liquid in said fluid continues to travel in the same direction, said fluid eventually exiting through an exit opening into the environment, but each deflector diverts a portion of gas in said fluid such that this gas travels around said deflectors into said openings and into said first passageway which directs the gas to said at least one second passageway which directs the gas to the bearings of a cutting member to cool and clean the bearings;

wherein each deflector of said plurality of deflectors is associated with a plurality of openings.

10. A drill bit having fluid circulation, comprising:

a main body;

at least one cutting member rotatably attached to said main body;

bearings for reducing friction between said main body and each cutting member;

a first passageway interior to said main body having one end which extends to a fluid source supplying a gas-liquid mixture and which has a plurality of openings, and having another end which extends to and opens into at least one second passageway interior to said main body, each said at least one second passageway extending to and opening into said bearings of a cutting member; and a plurality of axially spaced-apart deflectors associated with said openings such that when fluid is carried in the main cavity and is directed toward said openings, liquid in said fluid continues to travel in the same direction, said fluid eventually exiting through an exit opening into the environment, but each deflector diverts a portion of gas in said fluid such that this gas travels around said deflectors into said openings and into said first passageway which directs the gas to said at least one second passageway which directs the gas to the bearings of a cutting member to cool and clean the bearings;

wherein said first passageway has a resilient member which is placed on its interior surface to seal said openings when fluid circulation in the drill bit stops.

11. A method of utilizing the gas in a liquid-gas fluid mixture so as to cool and to clean the bearings of a drill bit, said drill bit comprising a main body, at least one cutting member rotatably attached to said main body, and bearings for reducing friction between said main body and each cutting member, comprising the steps of:

(a) passing said liquid-gas fluid mixture into a cavity in the interior of said main body and sequentially past a plurality of deflectors in said cavity;

(b) diverting, by each deflector of a plurality of deflectors which are sequentially in the path of said fluid mixture in said cavity, a substantially liquid-free portion of the gas in said fluid mixture into a plurality of openings which are associated with the respective deflector while the remainder of said fluid mixture continues past said deflectors and said openings, said openings providing entranceways into a passageway leading to the bearings; and (c) directing all portions of gas diverted into said openings through said passageway so that the thus diverted gas is in proximity with said bearings so as to cool and clean the bearings.

12. A method of utilizing the liquid in a liquid-gas fluid mixture to suppress dust during drilling operations involving the use of a drill bit and utilizing the gas in said liquid-gas fluid mixture so as to cool and to clean the bearings of the drill bit, said drill bit comprising a main body, at least one cutting member rotatably attached to said main body, and bearings for reducing friction between said main body and each cutting member, comprising the steps of:

(a) passing said liquid-gas fluid mixture sequentially past a series of deflectors in a cavity in the interior of said main body so that a portion of the gas in said fluid is diverted by each of said deflects into at least one opening associated with the respective deflector, each thus diverted portion of gas being at least substantially free of liquid, said openings providing entranceways into a passageway leading to the bearings;

(b) directing all of the portions of gas thus diverted into said opening through said passageway so that the thus diverted gas is in proximity with said bearings so as to cool and clean the bearings; and (c) directing liquid in said fluid sequentially past said deflectors and then through an exit opening provided in said main body of said drill bit, said liquid directed through said exit opening exiting into the environment to suppress dust during drilling operations.

13. A drill bit in accordance with claim 1, wherein each deflector of said plurality of deflects is associated with a plurality of openings.

14. A drill bit in accordance with claim 1, wherein each said at least one passageway has a resilient member on its interior surface to seal said plurality of openings when fluid circulation in the drill bit stops.

15. A drill bit in accordance with claim 1, wherein said main body further comprises an exit opening extending from an exit location in said cavity into the environment, said exit location being downstream, with respect to the flow of liquid in said cavity, from said plurality of deflectors, so that liquid eventually exits the cavity through said exit opening.

16. A drill bit in accordance with claim 15 containing a plurality of cutting members, wherein said at least one passageway comprises a single conduit extending at least substantially coaxially into said cavity as said other end and a plurality of second passageways, each of said second passageways providing fluid communication between said single conduit and the bearings for a respective cutting member.

17. A drill bit in accordance with claim 16, wherein each deflector of said plurality of deflectors is associated with a plurality of openings.

18. A drill bit in accordance with claim 16, wherein each deflector of said plurality of deflectors is associated with a single opening.

19. A drill bit in accordance with claim 16, wherein each said conduit has a resilient member on its interior surface to seal said plurality of openings when fluid circulation in the drill bit stops.

20. A drill bit in accordance with claim 16, further comprising an annular perforated member positioned in said cavity extending between said conduit and the wall of said cavity, and a resilient member mounted in juxtaposition to said perforated member to seal perforations in said perforated member when fluid circulation in the drill bit stops.

* * * * *

UNITED STATES PATENT AND TRADEMARK OFFICE

CERTIFICATE OF CORRECTION

PATENT NO. : 5,012,876

DATED : May 7, 1991

INVENTOR(S) : Tod T. Bruchmiller

It is certified that error appears in the above-identified patent and that said Letters Patent is hereby corrected as shown below:

Column 12, line 8, change "deflects" to --deflectors--;
line 15, change "opening" to --openings--;
line 25, change "deflects" to --deflectors--.

Signed and Sealed this

First Day of June, 1993

*Attest:*

Michael K. Kirk

MICHAEL K. KIRK

*Attesting Officer*

*Acting Commissioner of Patents and Trademarks*